United States Patent [19]

Merle

[11] 4,047,133

[45] Sept. 6, 1977

[54] CONTINUOUS CORRUGATED WAVEGUIDE AND METHOD OF PRODUCING THE SAME

[75] Inventor: Michel Merle, Elmira, N.Y.

[73] Assignee: Andrew Corporation, Orland Park, Ill.

[21] Appl. No.: 643,369

[22] Filed: Dec. 22, 1975

Related U.S. Application Data

[60] Division of Ser. No. 397,955, Sept. 17, 1973, Pat. No. 3,938,244, which is a continuation-in-part of Ser. No. 315,101, Dec. 14, 1972, abandoned, which is a continuation of Ser. No. 235,161, March 16, 1972, abandoned, and Ser. No. 238,458, March 27, 1972, abandoned.

[51] Int. Cl.[2] ..... H01P 3/14

[52] U.S. Cl. ..... 333/95 A; 333/98 R

[58] Field of Search ..... 333/95 R, 95 A, 98 R

[56] References Cited

U.S. PATENT DOCUMENTS

| | | | |
|---|---|---|---|
| 3,372,352 | 3/1968 | Krank et al. | 333/95 A |
| 3,444,487 | 5/1969 | Krank et al. | 333/95 A |

FOREIGN PATENT DOCUMENTS

| | | | |
|---|---|---|---|
| 417,052 | 8/1909 | France | 333/95 A |
| 1,063,234 | 8/1959 | Germany | 333/95 A |

*Primary Examiner*—Paul L. Gensler

*Attorney, Agent, or Firm*—Leydig, Voit, Osann, Mayer & Holt, Ltd.

[57] ABSTRACT

A method of producing continuous lengths of coilable corrugated wave guide of rectangular cross-section which comprises forming a smooth-wall metal tube wth a uniform wall thickness along the entire length and around the entire periphery, and transversely corrugating the walls of the tube along crest and root lines that form a substantially constant perimeter length around any cross-section of the corrugated tube taken perpendicular to the axis of the tube at any point along the length of the tube. In one embodiment, the corrugations of intersecting walls are offset at their intersection so that the crests of the corrugations of each wall meet the roots of the corrugations of the adjacent wall at each corner, with zigzag crests along the corners providing rigidity. In another embodiment, the corrugations are aligned with each other in each pair of intersecting sidewalls with the walls of one corrugation in each intersecting pair being folded outwardly alongside the walls of the other corrugation in that pair beginning at the line of intersection of that pair of corrugations. The smooth-wall metal tube is preferably formed from an elongated flat strip of metal having the longitudinal edges thereof joined to each other, and having a wall thickness of from 0.01 inch to 0.05 inch.

29 Claims, 25 Drawing Figures

FIG. 1
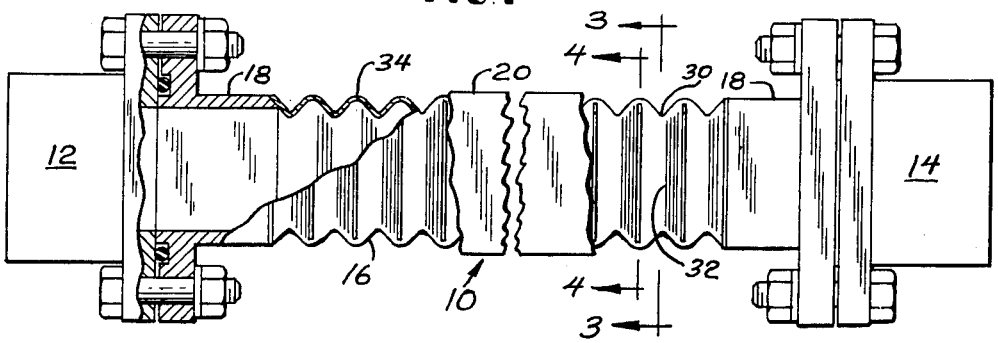
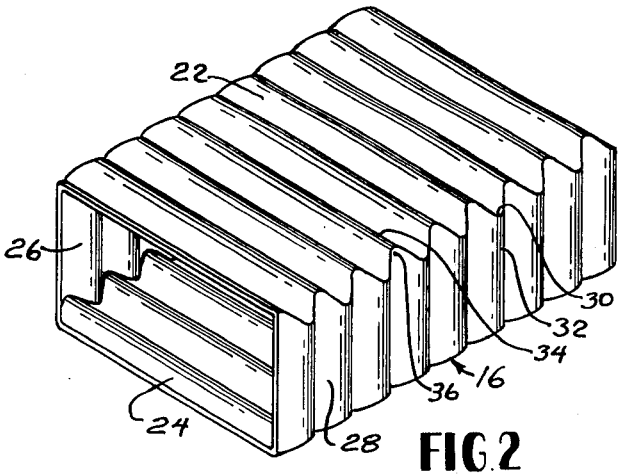
FIG. 2
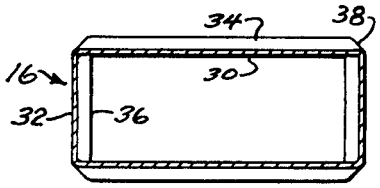
FIG. 3
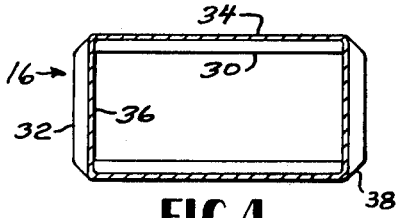
FIG. 4
FIG. 6
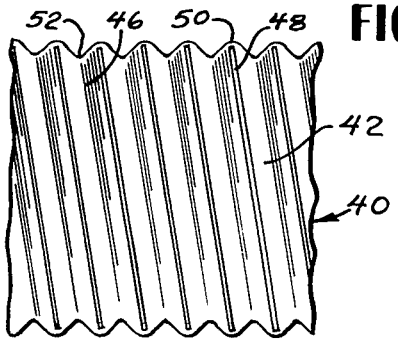
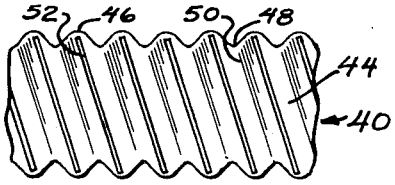
FIG 7
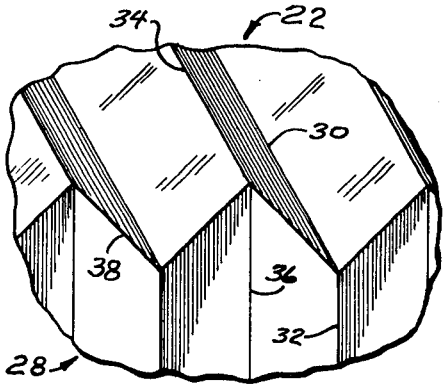
FIG. 5

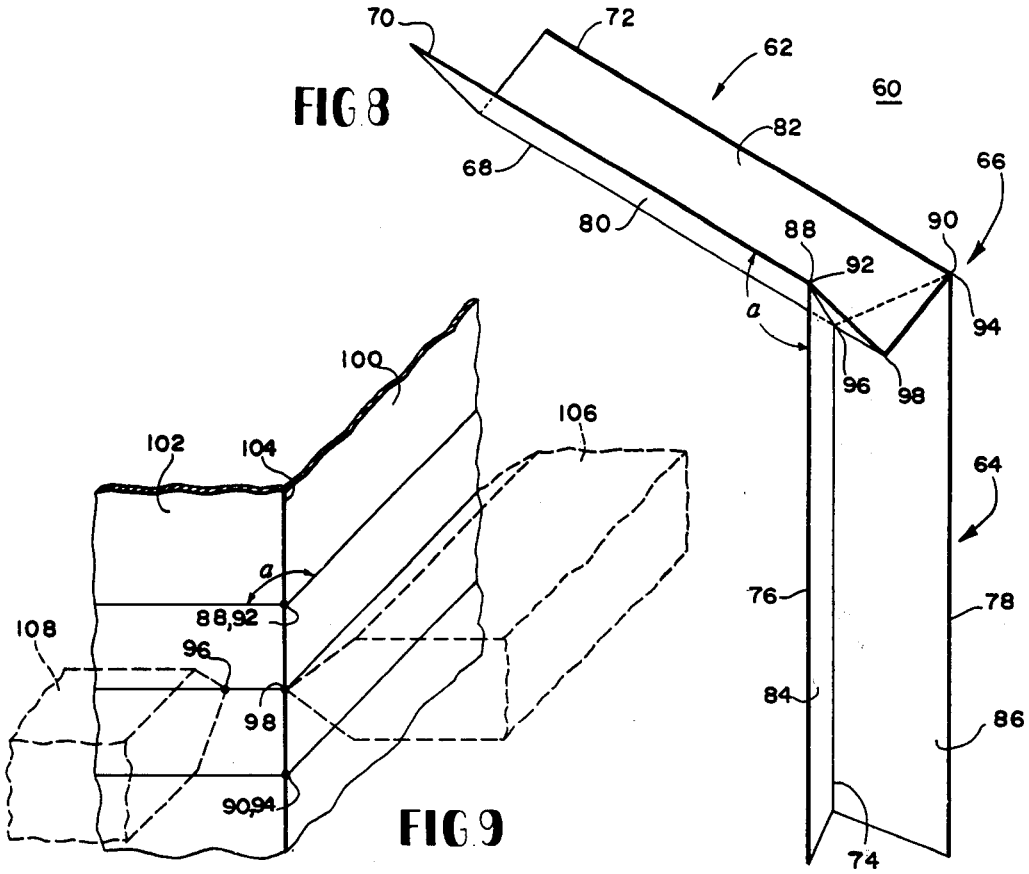
FIG. 8
FIG. 9
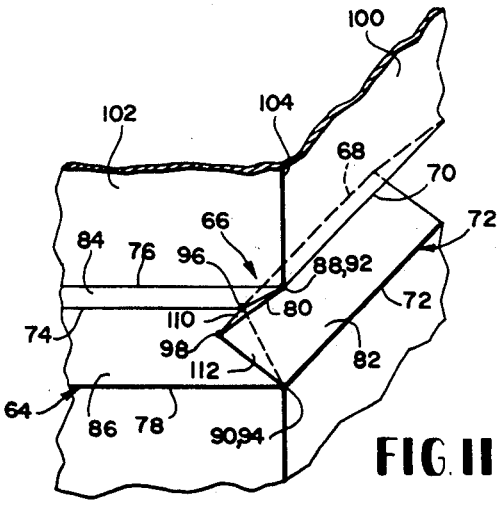
FIG. 11
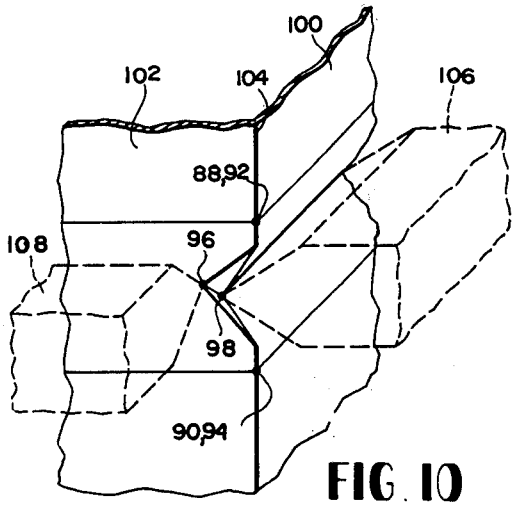
FIG. 10

100
102
62
64
88,92
90,94
98
78
84
74
76
120
122
124
126
128
130
132
134
136
138
140
142,98
144
96
146
100'
102'
150

152
158

CONTINUOUS CORRUGATED WAVEGUIDE AND METHOD OF PRODUCING THE SAME

CROSS REFERENCE TO RELATED APPLICATIONS

This application is a division of my co-pending application Ser. No. 397,955, filed Sept. 17, 1973, entitled "Continuous Corrugated Waveguide And Method Of Producing The Same", now U.S. Pat. No. 3,938,244, which was a continuation-in-part of my applications:

Ser. No. 315,101, filed Dec. 14, 1972, entitled "Corrugated Waveguide," now abandoned, which is a continuation of my now abandoned application Ser. No. 235,161, filed Mar. 16, 1972, entitled "Corrugated Waveguide," and Ser. No. 238,458, filed Mar. 27, 1972, entitled "Corrugated Conduit," now abandoned.

DESCRIPTION OF THE INVENTION

This invention relates to high-frequency waveguide, and more specifically to corrugated waveguide of the type made in long lengths by a continuous process and capable of being stored and handled on reels, and bent in installation, in the same general manner as cable.

As has long been known, a waveguide of rectangular cross-section provides the most satisfactory electrical performance in most common waveguide uses, and the vast bulk of the rigid smooth-wall waveguide employed in microwave transmission systems is of this shape. Such waveguide, however, has severe disadvantages of both cost and utility as compared to flexible waveguide which can be manufactured and used in the same general manner as cable, and is relatively impractical where microwave transmission over substantial distances is involved. Flexible waveguide is accordingly in fairly wide use for such purposes but has, prior to the present invention, involved substantial compromise of performance.

The most satisfactory flexible waveguide for such purposes known prior to the present invention is corrugated elliptical waveguide (this description, as used in the art, referring to any generally elliptical or oval shape). Such waveguide is commercially fabricated by a continuous process wherein a smooth-wall tube is formed from strip and thereafter corrugated and shaped. The elliptical shape has long been used despite drawbacks which are well-known to make a rectangular shape more desirable. As one obvious example, since the terminal equipment which is linked by a long waveguide length normally incorporates rectangular waveguide, transition fittings and the like most normally be employed at the ends of the elliptical guide. In addition, of course, the usable bandwidth of any overall system is limited to the bandwidth of the elliptical guide, which is necessarily more restricted than that of a comparable rectangular guide. Accordingly, numerous efforts have been made in the prior art to devise a guide generally similar to elliptical corrugated guide, but of a more closely rectangular shape. Prior to the present invention, no construction for such a guide has been devised which was found sufficiently satisfactory to be widely used, although the need has at all times been recognized both by users and producers of flexible waveguide, and flexible rectangular guide made by relatively expensive processes has been provided for use in specialized applications.

The present invention flows from experimental and theoretical study of the fabrication difficulties heretofore encountered in making a fully practical corrugated rectangular waveguide by a continuous process, which have till now been apparently found prohibitive despite the relative simplicity of such manufacture of coaxial cable and elliptical waveguide, and the repeated efforts to employ such processes in manufacture of guide generally like that of U.S. Pat. No. 2,556,187 and similar prior art. The observations thus made have been employed to devise a relatively small structural modification which not only solves the fabrication problems but is also experimentally found to produce electrical performance superior to guide of much more expensive constructions.

Elliptical corrugated waveguide is normally fabricated by corrugating a round tube formed from strip and then deforming the tube to elliptical shape.

In the case of elliptical guide, as in the case of coaxial cable, the corrugations serve an extremely important function in addition to providing flexibilty, this being the rigidizing of the cross-sectional shape against easy deformation so that relatively thin walls may be employed, the depth of the corrugations being large compared to the wall thickness but small compared to the guide dimensions. In principle, it would appear that a round corrugated tube may be deformed to rectangular shape rather than elliptical shape. It is found, however, that any attempt to make reasonably sharp corners in this manner results in substantially entire loss of mechanical strength due to local crushing and distortion of the corrugations at the corners. At least equal difficulty is encountered in attempting to form similar corrugations after, rather than before, a generally rectangular shape is established; it is found virtually impossible to produce such corrugations which are of any strength at the corners, even with fairly generous corner rounding and consequent reduction of useful bandwidth.

Another problem in the formation of corrugated waveguide (of any cross-sectional configuration) from continuous smooth-wall tubing is the production of excessive metal thickness in certain portions of the guide. Because the continuous tube normally has a constant wall thickness around its circumference and along its entire length before it is corrugated, any variations effected in the cross-sectional perimeter of the tube by the corrugating operation result in stretching of the metal with consequent reductions in the metal thickness in the stretched areas. This thinning of the metal in the stretched areas requires that the metal in the other areas of the corrugated tube, and throughout the entire starting tube, have a thickness greater than would otherwise be required because it is not feasible to prefabricate the tube with a variable wall thickness to provide just the amount of metal required in each increment of the final corrugated product. This excessive metal thickness in the unstretched areas of the corrugated tube is especially objectionable in the fabrication of waveguide because the well known "skin effect" phenomenon in high frequency transmission permits the use of extremely thin metal, so that any excessive metal thickness necessitated by the fabricating technique results in an undesirable increase in the cost of the waveguide beyond that required for the desired technical performance of the product.

It is, therefore, a primary object of the invention to provide an improved corrugated waveguide and a method of manufacturing the same in continuous lengths which avoid excessive metal thicknesses and which also avoid local crushing and distortion of the corrugations at the corners of intersecting side walls of the waveguide.

More specific objects of the invention are to provide such an improved waveguide and method of manufacturing the same which minimize the cost of the waveguide by minimizing the amount of metal required, and which provide considerable mechanical strength around the entire periphery of the waveguide including the corner regions of intersecting side walls.

Another important object of the invention is to provide an improved corrugated waveguide and manufacturing method of the foregoing type which also provide desirable electrical characteristics for high frequency transmission. Thus, a related object of one aspect of the invention is to provide a practical method of manufacturing continuous lengths of flexible rectangular waveguide having substantial mechanical strength.

It is a further object of the invention to provide such an improved corrugated waveguide and manufacturing method which provide improved mechanical characteristics such as ease of bending, a low minimum bending radius, and high crush strength.

Other objects and advantages of the invention will be apparent from the following detailed description and the accompanying drawings, in which:

FIG. 1 is a view in elevation, partially broken away in section, of a waveguide of the invention, together with schematically illustrated terminal equipment linked by the waveguide;

FIG. 2 is a perspective view of a portion of the guide of FIG. 1;

FIG. 3 is a sectional view along the line 3—3 of FIG. 1;

FIG. 4 is a sectional view along the line 4—4 of FIG. 1;

FIG. 5 is an enlarged view of a portion of FIG. 2, showing the external corner construction and exaggerating the sharpness of corrugation bends for clarity of illustration;

FIG. 6 is a top plan view of a modified waveguide of the invention;

FIG. 7 is a side view of the waveguide of FIG. 6;

FIG. 8 is a schematic diagram of a corrugation element illustrating two intersecting corrugated segments and the corner at that intersection used in a modified embodiment of the corrugated waveguide according to this invention;

FIG. 9 is a schematic diagram of a portion of a waveguide including two intersecting smooth surfaces which are about to have a corrugation formed in them according to this invention and showing two tools which may be used to make the corrugation;

FIG. 10 is an illustration similar to FIG. 9 showing the two corrugations and the folded corner partially formed;

FIG. 11 is an illustration similar to that shown in FIGS. 9 and 10 with the two intersecting corrugations and the corner fully formed;

FIGS. 21 (A) through (D) show a number of closed structures which may be made according to this invention.

Figures 12, 13, 14, 15, 16, 17:
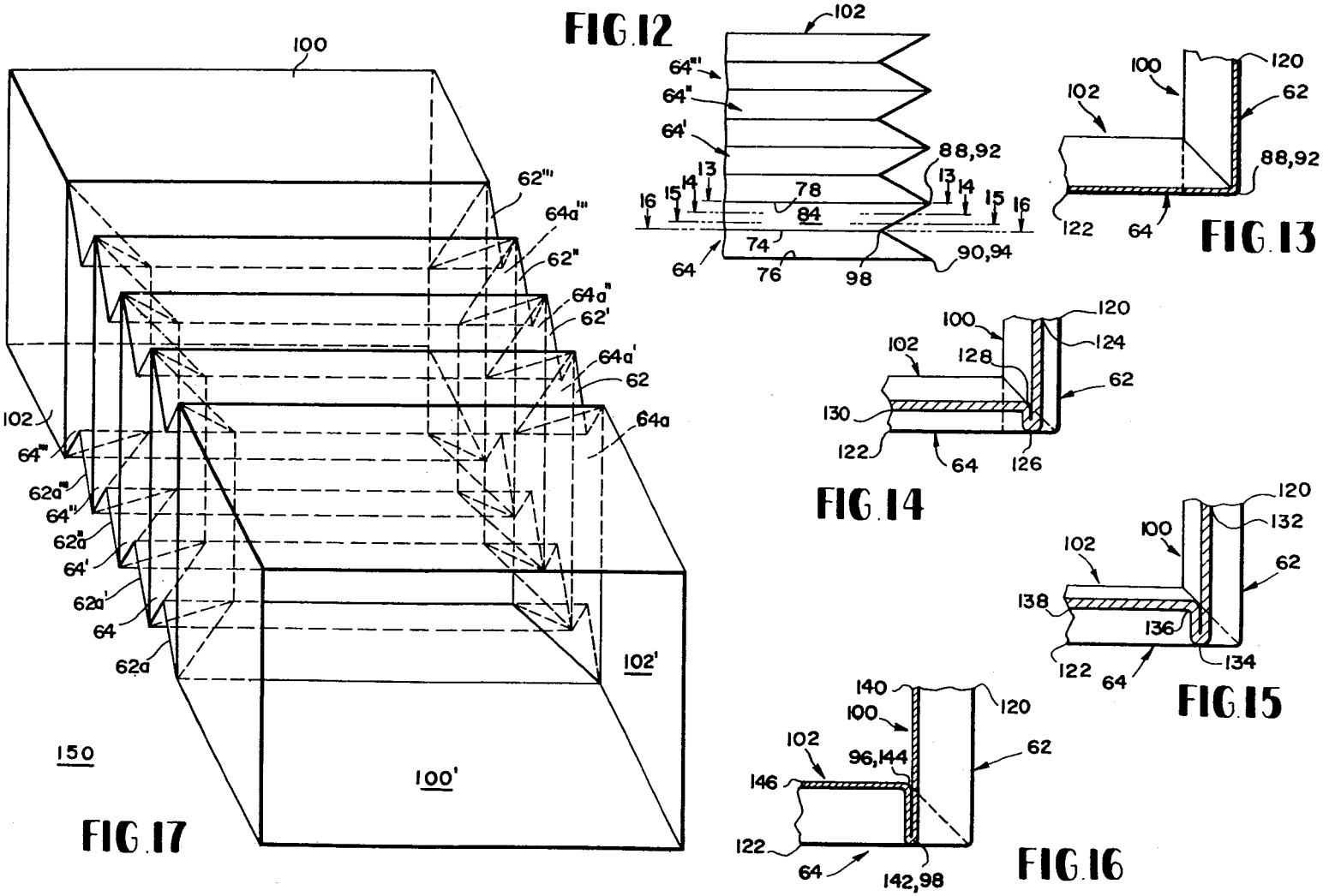
FIG. 12 is an elevational view of a portion of a corrugated waveguide according to this invention.
FIG. 13 is a sectional view of a portion of the device shown in FIG. 12 taken along line 13—13.
FIG. 14 is a sectional view of a portion of the device of FIG. 12 taken along line 14—14.
FIG. 15 is a sectional view of a portion of the device of FIG. 12 taken along line 15—15.
FIG. 16 is a sectional view of a portion of the device of FIG. 12 taken along line 16—16.
FIG. 17 is an axonometric diagrammatic view of a rectangular corrugated waveguide made from a smooth rectangular tube according to this invention.

The present invention stems in part from the discovery that the foregoing problems can be overcome to a large extent by the use of particular types of corrugation patterns in the fabrication of continuous lengths of corrugated waveguide from continuous smooth and thin-walled tubing. Thus, an important aspect of the present invention is the use of a corrugating pattern that provides a constant cross-sectional perimeter along the entire length of the corrugated tube. Corrugation patterns of the type used in this invention have been included in the great variety of corrugation patterns used heretofore in a variety of different products, including not only waveguides but also bellows, conduits, etc., but these particular corrugation patterns have never been used in the corrugation of continuous smooth and thin-walled tubing. Nor has it ever been recognized that the use of these particular corrugation patterns would provide the significant advantages described herein when used to fabricate continuous lengths of waveguide by corrugating continuous smooth and thin-walled metal tubing. For examples of the manner in which these corrugation patterns have been used heretofore, see U.S. Pat. Nos. 2,603,120 (Rosenheim), and 1,944,128 (Heigh) and British Pat. No. 739,488.

Turning now to the drawings, FIG. 1 shows in schematic fashion a microwave waveguide link 10 (normally having bends, etc., omitted from the drawing) between equipment installations 12 and 14, such as antenna and transmitter, conventional except for the shape and construction of the waveguide 16. The flexible rectangular guide 16 is shown as terminating in flange connectors 18, but other forms of connectors may of course be used. As shown in FIG. 1, the guide 16 is enclosed in a suitable plastic sheath 20, omitted from other portions of the drawing. As better seen in FIGS. 2 through 5, the guide 16 has transverse corrugations on all four sides, i.e., the top 22, bottom 24, and side walls 26 and 28.

In accordance with one important aspect of this invention, the waveguide 16 is formed by corrugating a smooth-wall metal tube to form corrugations of intersecting walls of the tube which are offset at their intersection so that the crests of the corrugations of one of the intersecting walls meet the roots of the corrugations of the other wall, the wall-intersection shape of the longitudinally unobstructed interior being a sharp angle and the exterior including a zigzag crest connecting the ends of the corrugation crests of the intersecting walls. Thus, in the illustrative embodiment of FIGS. 1 – 5 the corrugations of the long walls 22 and 24 are in longitudinal register with each other, but are offset or staggered from the corrugations of the short walls 26 and 28, also in register with each other, by a distance corresponding to half the corrugation spacing, so that the roots or troughs 30 of the corrugations of the long walls meet at the corners with the crests or peaks 32 of the corrugations of the short walls and, by the same token, the crests 34 of the long walls meet at the corners with the roots or troughs 36 of the short walls.

The advantages obtained by the staggering or offsetting of the corrugations at the corners, as compared with unitary corrugated rectangular tubes having corrugations which are continuous at the corners, may be in part understood by study of FIGS. 3 and 4, showing the change of cross section with half a corrugation spacing along the length of the guide. By comparing FIG. 3 and FIG. 4 it will be seen that with the equal corrugation depths employed, the long sides in the latter cross section are shorter by two corrugation depths, while the short sides are longer by two corrugation depths. Stated otherwise, the perimeter of the corss-sectional shape is the same at both places. Where, on the other hand, corrugations perpendicular to the length are sought to be made without staggering, the perimeter of the rectangle varies by four times the corrugation depth with each half-cycle of the corrugated structure.

By the simple modification of staggering or offsetting the corrugations of one pair of walls with respect to those of the other pair of walls, the greatest difficulties of fabrication are essentially eliminated, as will be seen from comparison of the stressing and stretching of the metal required in one type of corrugation with that required in the other. Known practical corrugation methods for such general purposes apply inward bending and stretching forces to the metal. With the non-staggered transverse corrugation, such a corrugation operation is required to stretch the metal of the corrugation root to move it inwardly while at the same time producing a diminished perimeter around the corrugation root. Stated otherwise, the metal of the roots must be stretched in the direction longitudinal of the tube and contracted in the direction transverse of the tube. No practical way of shaping the corrugations in this manner at the corners of a rectangular tube has been found. Not only does the required perimeter alteration make it extremely difficult, or impossible, to avoid crushed and distorted corrugation-root corners, but in addition the required stretching of the metal for substantial corrugation depth in a rectangular tube is found virtually impossible with any reasonably practical corrugation process. Such difficulties are avoided by the staggered-corrugation construction.

With the corrugation crests staggered, further, each crest 32 and 34 is shorter in the transverse plane than the longitudinally adjacent roots or valleys 36 or 30. The metal of the tube along the corner forms a zigzag continuous crest 38 connecting the ends of the crests of the adjacent sides and extending in a generally diagonal plane intersecting the orthogonal planes of the adjacent sides, as most clearly seen in FIG. 5. This Figure shows sharply-angled corrugation roots and crests and sharply-angled corner crests 38 for aid in visualization; the crests at 38 actually formed, like the wall corrugations, are of course of the more or less sinusoidal or rounded shape familiar in corrugated tubing of this general type and seen in FIGS. 1 and 2. The corner thus formed is reinforced by the zigzag corrugation crests and strongly resists deformation of the external bevelled-corner rectangular shape, particularly by compression forces exerted on opposite external faces, against which elliptical guide is relatively weak.

Despite the external shape just described, the longitudinally unobstructed interior has a rectangular shape with every sharp right-angle corners. In itself, the internal configuration visually seen is not necessarily determinative of electrical transmission properties. Corrugated elliptical or circular tubing as widely used in waveguide and coaxial cable, although having propagating characteristics closely similar to smooth-wall tubing of the same shape, is known to have an effective dimension somewhat larger than the visually unobstructed passage, i.e., the internal dimension formed by the corrugation roots, but smaller than the internal dimension at the corrugation crests; that is to say, with the corrugations heretofore known for such purposes, the effective internal dimensions are intermediate between root dimensions and crest dimensions. The theoretical reasons for the relatively small effects of corrugations on propagation have, so far as is known, not been fully developed, but have been thought to flow from the substantially complete constancy of internal shape characterizing the forms of corrugation heretofore used in such tubing. In the present construction, the dimensional ratio of the rectangle of the section of FIG. 3 is somewhat different than that of FIG. 4, which might be expected to result in reflections and the like impairing propogation. It has nevertheless been found on trial that the offsetting of the corrugations of the intersecting walls of the present invention does not produce field perturbation effects materially altering the transmission charcteristics as regards propagated field patterns, operating frequency, or bandwidth, the staggered-corrugation guide having substantially the same characteristics in these respects as a sharp-cornered smooth-wall guide of the intermediate (between root and crest) dimensions, to which it may be coupled with relatively negligible mismatch at the interface.

As in the case of other known flexible corrugated high-frequency tubing, the attenuation factor is slightly higher than in a smooth-wall guide, the transmission losses varying somewhat with corrugation depth, which is accordingly kept small relative to guide dimensions.

The metal, thickness, corrugation depth and similar parameters desirably employed in the invention are broadly similar to those heretofore employed in elliptical waveguide, selection being based on the same general considerations of mechanical stability and flexibility, electrical performance, and cost. The most desirable materials are copper and aluminum of a thickness of from 0.1 inch to 0.5 inch. It will be noted that the illustrated 45° angle of the plane of the zigzag crest corners 38 is produced by equality of the corrugation depth on all sides, this angle being somewhat changed where corrugation depths are unequal; also inequality of corrugation depths introduces slight changes in perimeter with each half-cycle of the corrugated structure, thus making fabrication somewhat less simple. The gross relative dimensions of the rectangular structure are of course selected in accordance with conventional waveguide practice, with the width approximately twice the height.

The high-frequency transmission characteristics of a rectangular guide of the invention, coupled with mechanical ruggedness, make the invention advantageous for many uses for which elliptical waveguide is wholly unsuited, as well as for replacing elliptical waveguide in the long-length applications for which the latter has till now been the only practical construction. For example, the substantial duplication of performance of, and close direct impedance-match with, smooth-wall rigid rectangular waveguide make it feasible to use short lengths of the present waveguide in place of specially-fabricated bends, twist sections and the like which continue to be used as inserts in smooth-wall rectangular-guide systems despite their much higher cost than elliptical waveguide. Indeed the present flexible guide is suitable for entire substitution for rigid waveguide in all but the most exacting applications.

An exemplary variant form of the invention in its broader aspects is illustrated in FIGS. 6 and 7, showing the top and side of a guide generally similar to that already described but having corrugations, which, although generally transverse, are not wholly perpendicular to the length of the guide, having an angular pitch of the type produced by a corrugating tool moved in a transverse plane while the tubing is simultaneously fed longitudinally. The modified guide 40 has a top wall 42 and sdie wall 44, each corrugated in this fashion, the corrugation crests 46 and roots 48 in the top 42 being offset or staggered at the corners with respect to the crests 50 and roots 52 in the side wall 44. The angular relation to the corrugations to the axis of the guide is in each case such that the corrugation "advances" by one corrugation-spacing across the wall. To obtain the desired relationship at the corners, the pitch or slope angle of those of the corrugations of the side 44 is larger than the pitch or slope angle of those of the top 42. The corners are of the same configuration as in FIG. 5. The walls opposite those illustrated may have either the same or opposite corrugation pitch angles. If so desired, pitched or slanted corrugations on one pair of walls may be employed with fully transverse corrugations on the other pair of walls to produce the offsetting or staggering at the corners.

Adaptations of known manufacturing methods to production of the illustrated structure will be obvious to those skilled in the art. Most desirably the process of manufacture is of the continuous type wherein a tube is formed from strip, longitudinally welded, shaped to approximate rectangularity and thereupon corrugated, with the force exerted in corrugation aiding in deforming the tube to its final rectangular shape. Any of a variety of known corrugating tools and machinery may be employed, the task of making currugations of suitable depth being greatly simplified by the relatively small amount of stretching of metal which is necessary. Wholly transverse corrugations may be formed, if so desired, by merely passing the tube through opposed pairs of large gear-like corrugating wheels. No separate operation is required for forming the zigzag crests at the corners, the metal at this point automatically assuming such as shape upon formation of the staggered corrugations of the adjacent sides. Wholly transverse or perpendicular corrugations may of course also be formed by employment of a tool progressing across the wall, but in such event it is necessary either to intermittently stop the progression of the tube or to complicate the corrugating mechanism by also advancing the point of contact of the corrugating tool longitudinally of the tube while the tube continuously progresses.

In accordance with another specific aspect of the invention, a constant-perimeter waveguide is formed by corrugating a smooth-wall tube so that the corrugations in each pair of intersecting tube walls are aligned with each other, rather than being staggered, but with the walls of one corrugation in each intersecting pair of corrugations being folded outwardly alongside the walls of the other corrugation in that pair beginning at the line of intersection of that pair of corrugations. Thus, in FIG. 8 there is shown one pair of intersecting corrugations 60 including two segments 62 and 64 which intersect at corner 66 at an angle a. Segment 62 has a root or a first section 68 at a first level and two crests or second sections 70 and 72 at a second level spaced from the first level of section 68. Similarly segment 64 has a first section 74 at a first level and two second sections 76, 78 at a second level spaced from the level of first section 74. Webs 80 and 82 interconnect second sections 70 and 72, respectively, with first section 68 on segment 62; and webs 84 and 86 interconnect second sections 76 and 78, respectively, with first section 74 on segment 64. Ends 88 and 90 of second sections 70 and 72 intersect with ends 92 and 94 of second sections 76 and 78 to form a portion of corner 66. First section 74 of segment 64 is foreshortened so that its end 96 may receive first section 68 whose end 98 extends beyond first section 74 of segment 64. The amount of foreshortening is dependent both on the angle of intersection, a, and on the distance between the first and second level — i.e. the depth of each corrugated segment.

The folded geometry of corner 66 may be better understood with reference to FIGS. 9, 10 and 11 which show the method of forming corner 66. In FIG. 9 there are shown two smooth sides 100 and 102 of a waveguide intersecting at an angle a at edge 104. The area between point 89, 92 and point 90, 94 is to be made into a pair of corrugations intersecting at a folded corner by means of tools 106, and 108, shown in phantom, whose working heads are shaped to the desired cross-sectional form of the finished corrugations. Tool 106 extends completely over the edge 104 at point 98 whereas tool 108 ends short of edge 104 at point 96 which is a corrugation depth distant from point 98. In FIG. 10 as tools 106 and 108 have been moved to their mid-way position, point 88, 92 and point 90, 94 have come closer together to supply the material which has been depressed into the grooves being formed by the forward motion of tools 106 and 108. Finally in FIG. 11 the two corrugations segments 62 and 64 have been formed with a corner 66. The line defined by points 96 and 98 in FIG. 9 is parallel to the plane of side 102. However, in the finished corrugation, FIG. 11; the line defined by point 96 and 98 has been rotated 90° by the folding action performed by the tools 106 and 108 and is now parallel to the plane of side 100. First section 74 of segment 64 has been foreshortened by an amount equal to the distance between point 96 and point 98 and the two triangular pieces removed from webs 84 and 86, i.e., the triangular piece 110 defined by point 96, point 98, and point 88, 92 and the triangular pieces 112 defined by point 96, point 98 and point 90, 94 have been folded back along the bottom of webs 80 and 2. This folded form for corner 66 not only maes a geometrically neat construction but it also reinforces corner 66 by means of the double thickness of material provided by the two triangular pieces 110 and 112. Reinforced corner 66 increases the strength of the corrugated element in a transverse direction, i.e., against forces exerted on the sides 100, or 102. The depth of the corrugation of segment 62 is the same as the depth of corrugation of segment 64. The entire corrugation may be formed by the material contributed by the movement towards one another of the point 88, 92 and point 90, 94 and thus no distortion or thinning of the webs occurs at any point in the corrugations. However, If it is desired to make corrugations intersect which do not have the same depth of corrugation, e.g., if segment 64 were deeper than segment 62, this would be accommodated by stretching of the segment 64 to the extent of the difference in depth. The present invention, however, minimizes the stretching required to form such intersections and hence minimizes thinning of material. However, absent such differences in depth, corrugations 62 and 64 and corner 66 may be made without using the elasticity or plasticity of the material of sides 100 and 102, and a uniform wall thickness may be maintained throughout the entire corrugated structure.

A side elevational view of side 102 after three additional segments 64', 64'', and 64''' have been formed in it is shown in FIG. 12, wherein point 96 and first section 68 are hidden behind point 98 and section 70 is hidden behind point 88, 92 and section 72 is hidden behind point 90, 94.

The technique whereby the intersection of corrugation segments 62 and 64 is effected by the folding without distortion may be seen with reference to the sectional diagrams in FIGS. 13, 14, 15 and 16, where it will be observed that the distance from point 120 to point 88, 92 to point 122 in FIG. 13 is equal to the distance from point 124 to point 126 to point 128 to point 130 in FIG. 14 is equal to the distance from point 132 to point 134 to point 136 to point 138 in FIG. 15 is equal to the distance from point 140 to point 142 to point 144 to point 146 in FIG. 16. Corrugations formed in this manner fold and unfold rather than stretching or deforming in response to extending or retracting of the waveguide. Also, since the corrugations may be formed without any thinning or distortion of the original workpiece, the resulting corrugated waveguide has the same thickness throughout as the original uncorrugated workpiece.

The corrugated waveguide of this invention may be formed with two or more sides. For example, there may be four such corrugated sides, each side having a plurality of corrugations and each such side intersecting with two other sides at a plurality of corners to form a rectangular waveguide 150, FIG. 17. Corrugated waveguide 150 includes four sides, 100, 102, 100' and 102' and four groups of corrugated segments 62, 62', 62'', 62''' and 64, 64', 64'', 64''', and *62a, 62a', 62a'', 62a'''*, and *64a, 64a', 64a'',* and *64a'''*, respectively, In FIG. 17 segements 64, 64', 64'', 64''' and segments *64a, 64a', 64a'', 64a'''* are foreshortened at each end while segments 62, 62', 62'', 63''' are segments *62a, 62a', 62a'', 63a'''* are foreshortened at neither end, but this is not a limitation of the invention; for example, each segment may be foreshortened at one end and not the other to form a corner at its intersection with the end of the corresponding segment. The neat, geometric construction of waveguide 150 enables its dimensions, both inner and outer, to be formed with the predictable accuracy which is considerable advantage in waveguides. In addition, any corrugation depth, pitch, and ratio of depth to pitch may be provided by using the formable corner of this invention, enabling the design of corrugated waveguides with any desired bending characteristics. Moreover, the substantially uniform wall thickness of the corrugated element provides an improved bending life over corrugated structures made by other techniques.

Figures 18, 19, 20, 21, 21A, 21B, 21C, 21D:
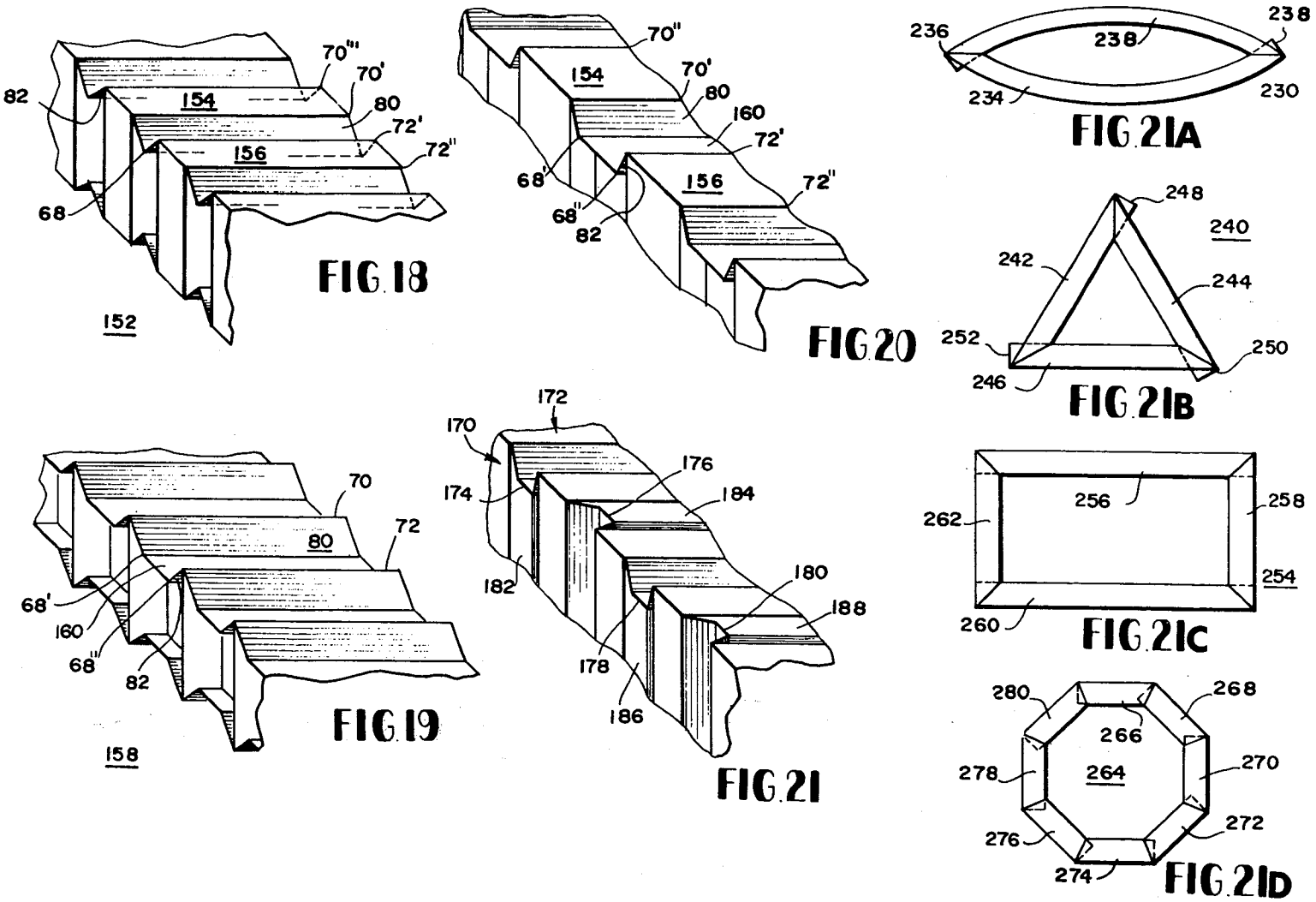
FIG. 18 is an axonometric diagram showing a portion of a corrugated waveguide according to this invention made with corrugations of an alternative cross-sectional shape.
FIG. 19 is an axonometric diagram showing a portion of a corrugated waveguide according to this invention made with corrugations of another alternative cross-sectional shape.
FIG. 20 is an axonometric diagram showing a portion of a corrugated waveguide according to this invention made with corrugations having yet another alternative cross-sectional shape.
FIG. 21 is an axonometric diagram showing a portion of a corrugated waveguide according to this invention made with corrugations of still another alternative cross-sectional shape.

Thus far the only corrugations shown to illustrate the invention have had a generally triangular or V-shaped cross-section, but this is not a limitation of the invention. In FIG. 18, where like parts have been given like numbers, waveguide 152 is shown with second section 70 of FIG. 8 severed to form two second sections 70' and 70'' interconnected by a web 154 and second sections 72 of FIG. 8 severed to form two second sections 72' and 72'' interconnected by a web 156. Thus in waveguide 152 alternate portions still have triangular or V-shaped cross-sections while those in between have a flat or rectangular cross-section. In FIG. 18 it is the root which retains the triangular cross-section while the crests assume the flat cross-section. However, in FIG. 19 the converse is true where first section 68 has been severed creating two sections 68' and 68'' interconnected by a web 160 such that in waveguide 158, FIG. 19, the roots are flat bottomed while the crests have a triangular or inverted V-shaped cross-section. Finally in FIG. 20 it is shown that none of the corrugations need have triangular or V-shaped cross-section: in FIG. 20 each of them has a rectangular or approximately rectangular cross-section with sloping sides.

In each of the illustrations of FIGS. 18, 19 and 20 all of the foreshortened corrugation segments are contained on one part which intersects with another part which contains a corresponding number of corrugation segments none of which is foreshortened, but this is not a limitation of the invention. In FIG. 21 two corrugated sides 170 and 172 intersect forming a plurality of corners 174, 176, 178, 180 such that at corners 174 and 178 the foreshortened segments 182 and 186, respectively, are on side 170 whereas at corners 176 and 180 the foreshortened segments 184 and 188, respectively, are on side 172.

Although the invention is of greatest utility in connection with coilable long-length rectangular waveguide, in its broader aspects it may be utilized in waveguide of other cross-sectional shapes having intersecting walls, particularly the various shapes heretofore proposed to procure greater useful bandwidth than can be obtained with elliptical guide. The corrugation patterns described may of course be employed to produce sharp internal angles other than a right angle, while at the same time producing a strong external corner or wall-intersection. For example, in FIG. 21 (A), (B), (C), and (D) there are shown a few of the many different shapes of waveguides which may be made according to this invention. None of the structures according to this invention is limited to the use of strictly straight segments as curved segments may be desirable, and are suitably interconnected at their points of intersection by a corner according to this invention. In FIG. 21 (A) is shown a waveguide 230 which includes two sets of curved segments 232 and 234 which intersect at two sets of corners 236 and 238; each of the segments in set 232 and eac of the segments in set 234 is foreshortened at one end. In FIG. 21 (B) waveguide 240 of traingular cross-section include three sets 242, 244 and 246 of straight segments which intersect in corners 248, 250 and 252. Each of the segments in each of set 242, 244 and 246 is foreshortened at one end only. A rectangular waveguide 254, FIG. 21 (C) includes four sets of segments 256, 258, 260 and 262. Each of the segments in sets 258 and 262 is foreshorshortened at each of its ends whereas none of the segments in sets 256 and 260 is foreshortened at either of its ends. In the final illustrative example, FIG. 21 (D), waveguide 264 has a polygonal cross-section including eight sets of segments 266, 268, 270, 272, 274 276, 278 and 280. Each of the segments in each of those sets is foreshortened at one end only.

In each of the figures the corners shown have sharp edges but this is not a necessary limitation of the invention. For example, if it is desired the corner structure may be made less severe and sharp such as when such sharpness would severely weaken the material. Such a rounded corner may be constructed by providing space between the triangular areas 110, 112 and webs 80, 82 which are in contact in FIG. 11. This rounding may be illustrated in FIG. 15 by simply providing a space between the section part extending between points 132 and 134 and the section part extending between points 134 and 136.

In addition, it is not neccessary to use a starting tube which has sharp edges such as illustrated in FIG. 17 to make the corrugated waveguide according to this invention, as it can be made using tubes having rounded edges or no clearly defined edges. Indeed, it is generally preferred to start with a tube having a circular cross-section.

I claim as my invention:

1. A method of microwave transmission comprising transmitting microwaves through an elongated waveguide extending between two spaced points and comprising a continuous flat strip of electrically conductive metal formed into a continuous length of a coilable corrugated tube having intersecting walls with the currugations in each pair of intersecting walls being aligned with each other, the walls of one corrugation in each intersecting pair of corrugations being folded outwardly alongside the walls of the other corrugation in that pair beginning at the line of intersection of that pair of corrugations.

2. The method of claim 1 wherein the crests and roots of the corrugations are all substantially V-shaped in cross-section.

3. The method of claim 1 wherein the roots of the corrugations are substantially V-shaped in cross-section and the crests of the corrugations are substantially flat on the tops thereof.

4. The method of claim 1 wherein the crests of the corrugations are substantialy V-shaped in cross-section and the roots are substantially flat in the bottoms thereof.

5. The method of claim of claim 1 wherein the crests of the corrugations are substantially flat on the tops thereof and the roots are substantially flat in the bottoms thereof.

6. The method of claim 1 wherein alternate intersecting pairs of corrugations have the walls of the corrugations in a first side wall folded outwardly alongside the walls of the corrugations in a second side wall, and the intervening pairs of corrugations have the walls of the corrugations in said second side wall folded outwardly alongside the walls of the corrugations in said first side wall.

7. A method of microwave transmission comprising transmitting microwaves through an elongated waveguide extending between two spaced points and comprising a corrugated tube having at least a first corrugated side intersecting at an angle with a second corrugated side forming at least first and second sets of corners, each side including a plurality of first sections and a plurality of second sections spaced from said first sections, the ends of said second sections of said first side being joined with the ends of said second sections of said second side to form a portion of the corners, another portion of each corner being formed by a first section of one of said sides foreshortened by a predetermined amount dependent on the angle of intersection and the depth of the corrugation in said sides, the end of said foreshortened first section intersecting a said first section of the other side at a distance from the end of that section, the portion of said foreshortened section removed from the extent of that section being folded back double along the corresponding first section of the other side from the end of that other first section back to the place where the end of the foreshortened section intersects that corresponding first section of the other side.

8. A waveguide formed of a continuous flat strip of electrically conductive metal, said strip being formed into a continuous length of a coilable corrugated tube of a rectangular cross-sectional shape having intersecting walls with one pair of parallel sides of the rectangle being substantially longer than the other pair of parallel sides, and tube having a substantially uniform wall thickness along the entire length and around the entire periphery thereof, the intersecting walls of said tube having transverse corrugations along crest and root lines that form a substantially constant perimeter length around any cross-section of the corrugated tube taken perpendicular to the axis of the tube at any point along the length of the tube, the depth of the corrugations being substantially smaller than the internal dimensions of the tube and substantially equal on all sides of the tube.

9. The wavelength of claim 8 wherein said corrugations of intersecting walls are offset at their intersection so that the crests of the corrugations at one of the intersecting walls meet the roots of the corrugations of the other wall, the wall-intersection shape of the longitudinally unobstructed interior being a sharp angle and the exterior including a zigzag crest connecting the ends of the corrugation crests of the intersecting walls.

10. The waveguide of claim 9 wherein said corrugations are offset at all four corners.

11. The waveguide of claim 8 wherein the longitudinal edges of the formed strip are abutted and joined to each other.

12. The waveguide of claim 8 wherein said strip has a thickness of from 0.01 to 0.05 inch.

13. The waveguide of claim 8 wherein said corrugations are aligned with each other in each pair of intersecting side walls, the walls of one corrugation in each intersecting pair of corrugations being folded outwardly alongside the walls of the other corrugation in that pair beginning at the line of intersection of that pair of corrugations.

14. The waveguide of claim 13 wherein the crests and roots of the corrugations are all substantially V-shaped in cross-section.

15. The waveguide of claim 13 wherein the roots of the corrugations are substantially V-shaped in cross-section and the crests of the corrugations are substantially flat on the tops thereof.

16. The waveguide of claim 13 wherein the crests of the corrugations re substantially V-shaped in cross-section and the roots are substantially flat in the bottoms thereof.

17. The waveguide of claim 13 wherein the crests of the corrugations are substantially flat on the tops thereof and the roots are substantially flat in the bottoms thereof.

18. The waveguide of claim 13 wherein alternate intersecting pairs of corrugations have the walls of the corrugations in a first side wall folded outwardly alongside the wall of the corrugations in a second side wall, and the intervening pairs of corrugations have the walls of the corrugations in said second side wall folded outwardly alongside the walls of the corrugations in said first side wall.

19. The waveguide of claim 8 wherein said corrugations form at least first and second sets of corners, each corrugated side wall forming a plurality of first sections and plurality of second sections spaced from said first sections, the ends of said second sections of first side wall being joined with the ends of said second sections of a second side wall to form a portion of the corners, another portion of each corner being formed by a first section of one of said sides foreshortened by a predetermined amount dependent on the angle of intersection and the depth of the corrugations in said side walls.

the end of said foreshortened first section intersecting one of the said first sections of the other side wall at a distance from the end of that section, and the portion of said foreshortened section removed from the extent of that section being folded back double along the corresponding first section of the other side wall from the end of that other first section back to the place where the end of the foreshortened section intersects that corresponding first section of the other side wall.

20. The waveguide of claim 19 in which each of the foreshortened first sections occur as the said first sections on the same one of said sides.

21. The waveguide of claim 19 in which some of said foreshortened first sections are on one of said sides and some are on the other.

22. The waveguide of claim 19 in which there are at least three sets of corners and each of said sections is straight.

23. The waveguide of claim 19 in which each of said sections is interconnected by a web to adjacent sections.

24. The waveguide of claim 23 in which each of said webs and sections are of approximately uniform thickness.

25. The waveguide of claim 19 in which all of said first sections of a said side are at a first level and all of said second sections are at a second level.

26. The waveguide of claim 25 in which the distance between said first level of said first sections and said second level of said second sections in each side is the same as the distance between said first level of said first sections and said second level of said second sections in every other side.

27. A continuous length of coilable corrugated waveguide of rectangular cross-sectional shape, said waveguide comprising a. a continuous flat strip of electrically conductive metal formed into tube with approximately a rectangular cross-sectional shape with one pair of parallel sides of the rectangle being substantially longer than the other pair of parallel sides, and with the longitudinal edges of the strip joined to each other, said strip having a thickness of from 0.01 inch to 0.05 inch.

b. the walls of said tube being transversely corrugated to form corrugations of adjacent intersecting walls which are offset at their intersection so that the crests of the corrugations of one of the intersecting walls meet the roots of the corrugations of the other wall and with the depth of the corrugations being substantially smaller than the internal dimensions of said tube and substantially equal on all sides of the tube, the wall-intersection shape of the longitudinal unobstructed interior being a sharp angle and the exterior including a zigzag crest connecting the ends of the corrugations crests of the intersecting walls.

28. A method of microwave transmission comprising transmitting microwaves through an elongated waveguide extending between two spaced points and comprising a continuous flat strip of electrically conductive metal formed into a continuous length of a coilable corrugated tube of a rectangular cross-sectional shape having intersecting walls with one pair of parallel sides of the rectangle being substantially longer than the other pair of parallel sides, said tube having a substantially uniform wall thickness along the entire length and around the entire periphery thereof, the intersecting walls of said tube having transverse corrugations along crest and root lines that form a substantially constant perimeter length around any cross-section of the corrugated tube taken perpendicular to the axis of the tube at any point along the length of the tube, the depth of the corrugations being substantially smaller than the internal dimensions of the tube and substantially equal on all sides of the tube.

29. The method of claim 28 wherein said corrugations of intersecting walls are offset at their intersection so that the crests of the corrugations of one of the intersecting walls meet the roots of the corrugations of the other wall, the wall-intersection shape of the longitudinally unobstructed interior being a sharp angle and the exterior including a zigzag crest connecting the ends of the corrugation crests of the intersecting walls.

* * * * *